United States Patent [19]

Vigh

[11] 4,347,034

[45] Aug. 31, 1982

[54] GAS TURBINE

[75] Inventor: Zoltan Vigh, Anaheim, Calif.

[73] Assignee: Zepco, Inc., Lincoln, Nebr.

[21] Appl. No.: 43,320

[22] Filed: May 29, 1979

[51] Int. Cl.[3] ..... F01D 1/04

[52] U.S. Cl. ..... 415/92; 415/202

[58] Field of Search ..... 60/722, 39.75; 415/92, 415/143, 185, 202

[56] References Cited

U.S. PATENT DOCUMENTS

| | | | |
|---|---|---|---|
| 238,763 | 3/1981 | Collins | 415/202 |
| 612,815 | 10/1898 | Bright | 415/92 |
| 846,762 | 3/1907 | Crary | 415/198.1 |
| 931,872 | 8/1909 | Holly | 415/199.6 |
| 1,040,199 | 10/1912 | High | 415/143 |

*Primary Examiner*—Jerry W. Myracle

*Attorney, Agent, or Firm*—Senniger, Powers, Leavitt and Roedel

[57] ABSTRACT

A gas turbine comprising a housing having a chamber of generally cylindrical periphery, a rotor mounted for rotation in the chamber, and a stator wall at one end of the chamber. The rotor has an end face in rotary sealing relationship with the stator wall and a peripheral surface in rotary sealing relationship with the periphery of the chamber. The rotor further has a plurality of recesses around its periphery, each recess extending radially into the rotor from the peripheral surface thereof and having a passage extending to the end face thereof. The housing has an inlet directing gas under pressure into the recesses. The stator wall blocks each passage at the end face for a part of a revolution of the rotor to hold the gas in the recesses for compression and is ported for exit of gas from each recess via its passage as the rotor rotates through another part of its revolution for expansion of the gas and resultant impulsing of the rotor. A second gas turbine embodiment having a combustor to provide gas under pressure for driving the turbine is also disclosed herein.

12 Claims, 14 Drawing Figures

GAS TURBINE

BACKGROUND OF THE INVENTION

This invention relates to rotary gas turbines and more particularly to rotary gas turbines having an output shaft to be connected to a rotatable load.

Rotary gas turbines of the axial-flow type have been widely used in such applications as stationary power plants, ships and aircraft. The advantages of such turbines include their relatively high power to weight ratio and their ability to be designed to meet the characteristics of the load to which they are to be coupled (e.g., high or low speed loads and high or low torque loads). A problem with the axial-flow turbine has been its relatively low operating efficiency. Early axial flow turbines were so inefficient that they produced barely enough power to drive their associated air compressor. Modern turbines having precision machined multi stage rotors have improved operating efficiency, but significant energy losses still occur particularly at the stators between the stages of the rotor. Moreover, the cost of manufacturing and maintaining such precision machined turbines is relatively high.

SUMMARY OF THE INVENTION

Among the several objects of this invention may be noted the provision of a turbine which has increased operating efficiency; the provision of such a turbine which operates at higher rotating speeds than prior gas turbines; the provision of such a turbine which is of simpler construction than prior turbines; the provision of such a turbine which is less costly to manufacture and maintain than prior art turbines; the provision of a combustor for use with rotary turbines which effects complete vaporization and combustion of the fuel to be burned therein; and the provision of such combustor which is more efficient and emits fewer pollutants than prior art combustors.

Briefly, a rotary gas turbine of this invention comprises a housing having a chamber therein for a rotor. The chamber has a periphery which is a surface of revolution about an axis extending through the chamber. The turbine further comprises a stator wall at one end of the chamber and a rotor mounted for rotation in the chamber on said axis. The rotor has an end face in rotary sealing relationship with the stator wall and a peripheral surface in rotary sealing relationship with the periphery of the chamber. The rotor also has a plurality of recesses spaced at equal intervals around its periphery. Each recess extends radially into the rotor from its peripheral surface and has a passage extending to the end face of the rotor. The housing has an inlet for gas under pressure for directing the gas into the recesses in the rotor. The stator wall is adapted to block each of the passages at the end face of the rotor throughout part of the revolution of the rotor to hold gas in each recess for compression and the stator wall is ported for exit of gas from each recess via the respective passage as the rotor rotates through another part of its revolution for expansion of the gas and resultant impulsing of the rotor.

A second gas turbine embodiment of this invention comprises a rotor having an interior surface defining first and second chambers and a shoulder between said chambers. The turbine further comprises a stator positioned in the first and second chambers and having a wall. Each of the chambers has a periphery which is a surface of revolution about an axis extending through the chamber. The second chamber is of a diameter larger than that of the first chamber and is open at its end opposite the shoulder. The shoulder of the rotor constitutes an annular surface around the axis of the rotor. The rotor is mounted for rotation about the stator. The interior surface of the rotor defining the first chamber is in rotary sealing relationship with the periphery of the stator and the shoulder of the rotor is in rotary sealing relationship with the wall. The rotor further has a plurality of recesses spaced at equal intervals around the periphery of the first chamber. Each recess extends radially outwardly into the rotor from the interior surface of the rotor defining the first chamber and has a passage extending to the shoulder of the rotor. The stator has a port for gas under pressure for directing the gas into the recesses in the rotor. The wall on the stator is adapted to block each of the passages at the shoulder of the rotor throughout a part of a revolution of the rotor to hold gas in the recesses for compression and the wall is ported for exit of gas from each recess via the respective passage as the rotor rotates through another part of its revolution for expansion of the gas and resultant impulsing of the rotor. The stator constitutes a combustor comprising a body having a chamber therein constituting a combustion chamber, an interior surface constituting the peripheral surface of the chamber, a gas inlet port for gas under pressure at one end of the body for directing gas in a stream into the chamber, a fuel inlet port for directing fuel into the chamber, and an outlet port at the other end of the body which constitutes the port for directing gas under pressure into the recesses. The gas inlet port directs the stream of gas into the chamber with an axial component and a tangential component (i.e., in a vortex). The fuel vaporizes in the gas and burns within the chamber. The interior surface has a groove extending helically from the gas inlet port to the outlet port for causing the stream of gas to flow through the combustion chamber in a vortex flow path (i.e., with an axial component and a circular component) so as to enhance the vaporization and complete combustion of the fuel. The outlet port directs the gaseous products of combustion out of the chamber and toward the recesses of the rotor along a path generally tangential to the combustion chamber.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
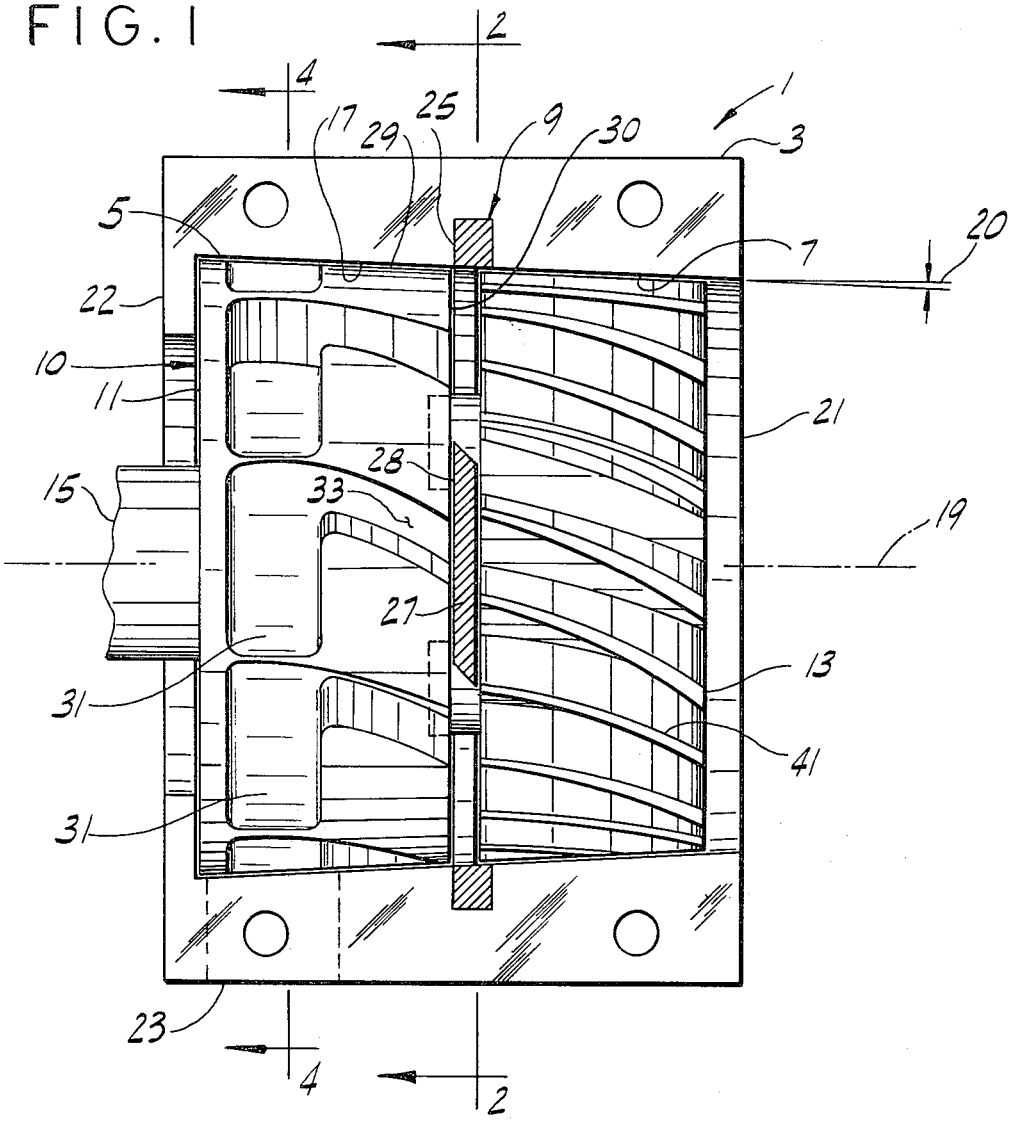
FIG. 1 is a plan of a first rotary gas turbine of this invention with parts removed showing a rotor having a first stage and a second stage and a stator wall between the stages.

Referring to the drawings, first more particularly to FIGS. 1–9, there is generally indicated at 1 a first rotary or convex gas turbine of this invention. The turbine comprises a housing 3 having a first stage rotor chamber 5 and a second stage rotor chamber 7 therein with a stator wall or partition 9 between the chambers. The turbine further comprises a rotor 10 having a first stage 11 in the first chamber 5 and a second stage 13 in the second chamber 7. The rotor 10 is secured to a rotary output shaft 15 extending from one end of the housing. The shaft is rotatably mounted in bearings (not shown) at the end of the housing 3 and is adapted to be coupled to a rotatable load (not shown). Preferably, the first and second stages of the rotor 10 and the shaft 15 are integrally formed (see FIG. 1), such as by casting, but it is also contemplated that the first and second stages may be separate elements secured to a separate shaft by conventional fastening means such as a key and keyway (not shown).

Figure 2:
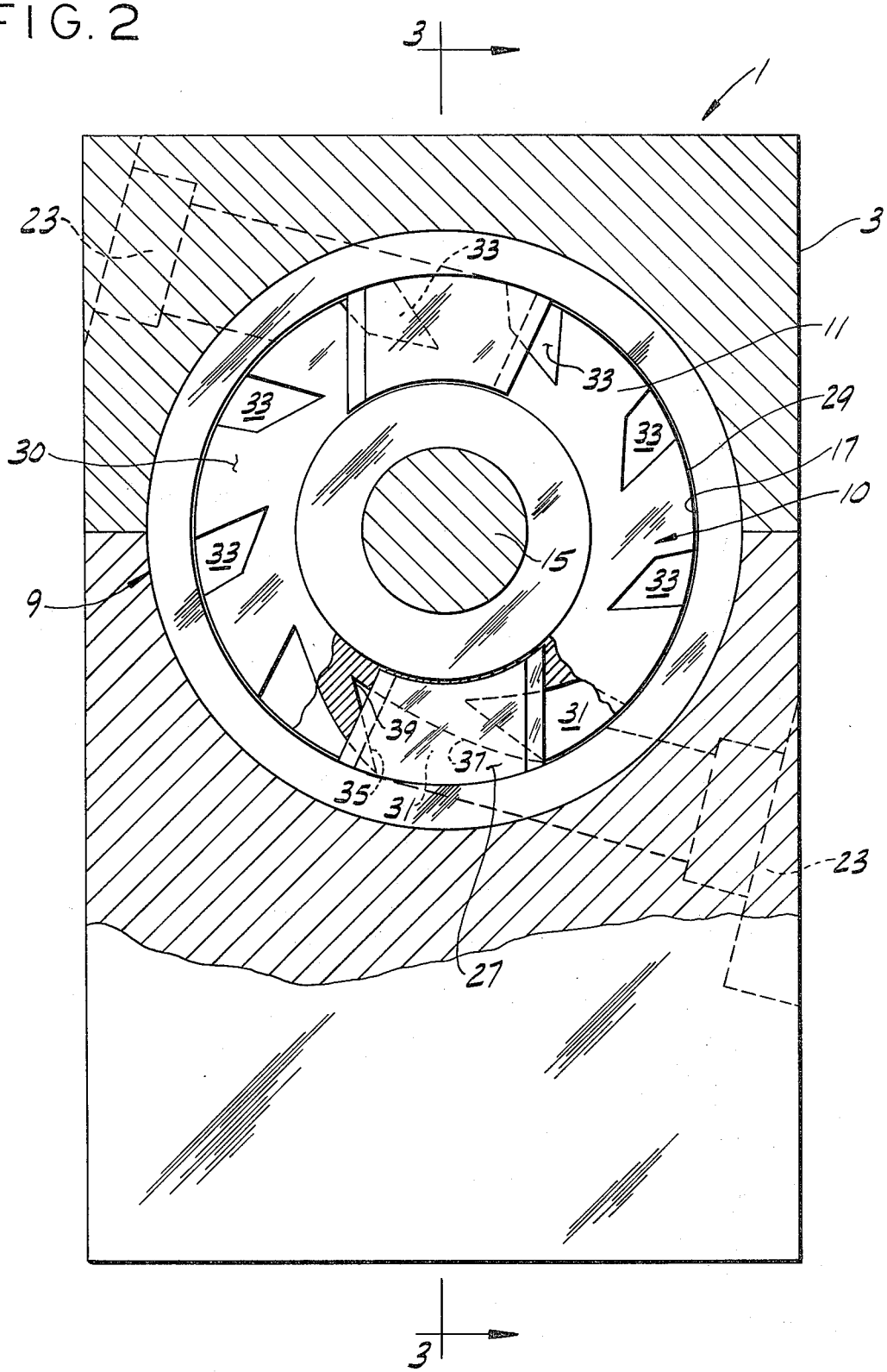
FIG. 2 is a section on line 2—2 of FIG. 1 with a portion of the first stage of the rotor broken away.
Figure 3:
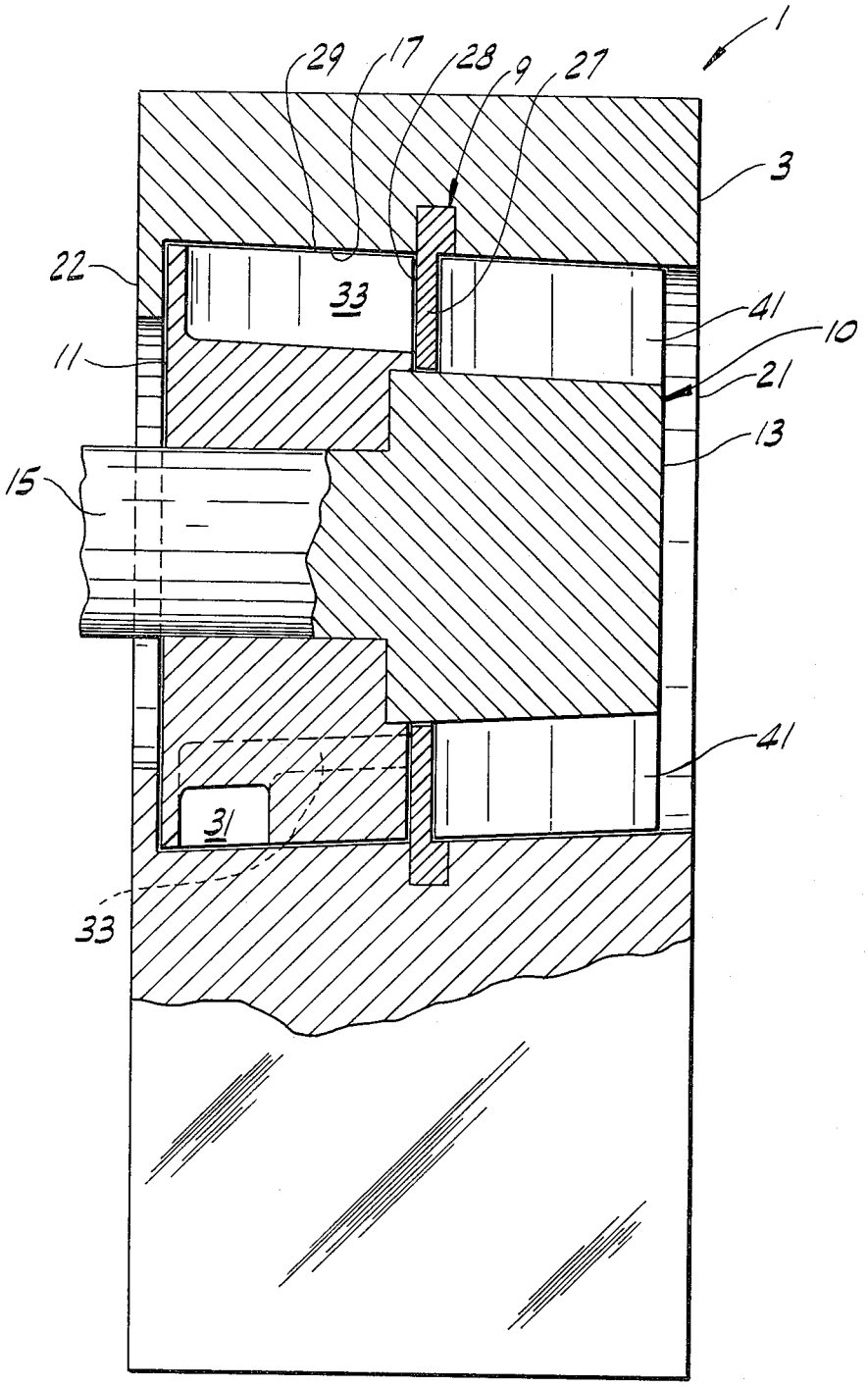
FIG. 3 is a section on line 3—3 of FIG. 2.
Figure 4:
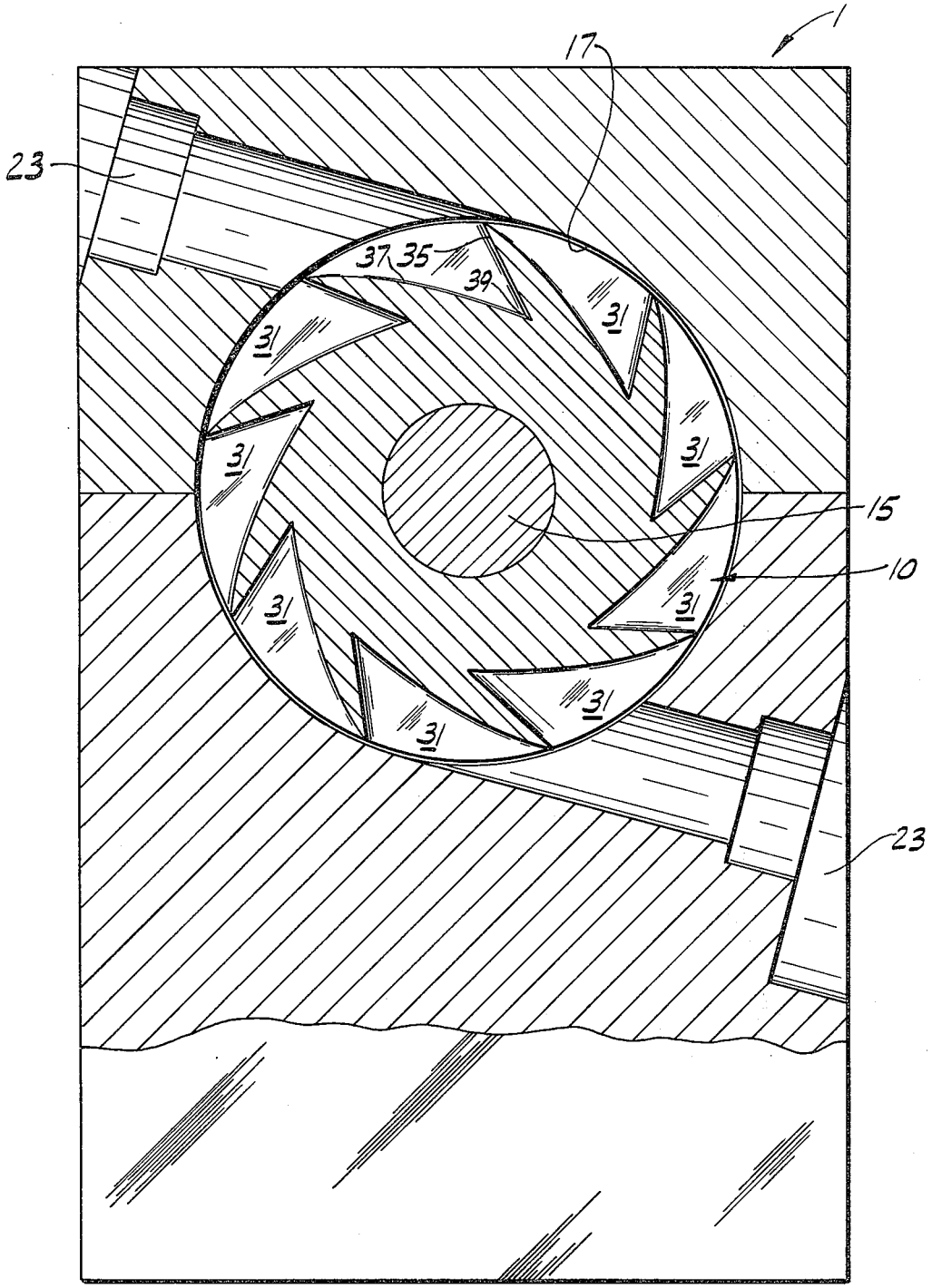
FIG. 4 is a section on line 4—4 of FIG. 1.

In particular, the housing 3, as shown in FIG. 2, is preferably of a two-part construction with the parts releasably secured together by conventional fastening means and it has, as shown in FIG. 1, an interior surface 17 that defines a chamber having a periphery which is a surface of revolution about an axis 19 extending through the chamber. The chamber converges inwardly toward the axis 19 at an angle 20 of approximately 2.5° and is open at its end 21 away from the shaft 15 and partially closed at its other end (i.e., the end toward the shaft) by shoulder 22 (see FIG. 1). This tapering configuration of the chamber (i.e., a chamber of decreasing diameter) reduces the flow area for gas flowing through the chamber and, hence, helps maintain the velocity of the gas as its energy is converted to rotary shaft work by the second stage 13. The stator wall or partition 9 is secured to the housing 3 at its interior surface 17 and divides the chamber into the first stage rotor chamber 5 and the second stage rotor chamber 7. As shown in FIGS. 2 and 4, the housing has one or more inlets 23 for gas under pressure for directing the gas under pressure toward the first stage of the rotor at an angle for propulsion of the rotor. A source of gas under pressure such as a source of steam or a combustor (not shown) is in communication with each inlet 23. While two inlets 23 are shown, the number of inlets can vary depending, inter alia, upon the size of the turbine, the flow rate of the gas through each inlet and the steady state rotating speed of the turbine 1.

The stator wall or partition 9 preferably comprises a ring 25 of one-piece or split construction adapted to be received in an annular recess in the housing 3, and a number of closing sectors 27 one for each gas inlet 23 extending radially inwardly from the ring 25 toward the axis 19 of the turbine (see FIG. 2). Each closing sector 27 has an imperforate axial surface 28 and extends for an arc of the periphery of the chamber (approximately 40° as shown in FIG. 2). The stator wall 9 has an open or ported portion between adjacent closing sectors 27. Each closing sector 27 blocks gas flow between the first stage and the second stage for compression of the gas in the recesses 31 (i.e., for a compression zone) as more fully described hereinafter, while each open portion enables communication between the rotor stages.

The first stage 11 of the rotor has a peripheral surface 29 in rotary sealing relationship with that portion of the interior surface 17 of the housing 3 defining the periphery of first stage rotor chamber 11 and has an end face 30 in rotary sealing relationship with the imperforate axial surfaces 28 of the closing sectors 27 of the partition 9 for the compression zone. The other end face of the first stage 11 is at the inner axial surface of the shoulder 22 of the housing 3. The first stage 11 also has a plurality of recesses 31 spaced at equal intervals around its periphery. Each recess 31 extends radially into the first stage from its peripheral surface 29 and has a passage 33 extending to the end face 30 of the first stage (see FIG. 5). The passage 33 may comprise a bore (not shown) spaced radially inwardly from the peripheral surface 29 of the first stage. Alternatively, the passage 33 may extend radially outwardly to the peripheral surface 29 of the first stage (see FIGS. 1, 3 and 5), in which case the interior surface 17 of the housing closes the side of the passage 33 extending to the peripheral surface 29 of the first stage rotor 11.

The passages 33, in addition to extending axially to the end face 30 of the first stage may curve, as shown in FIGS. 1 and 6–8, in a trailing direction with respect to an axial plane of the rotor 10 (trailing in the sense of the direction of rotation of the first stage rotor 11 away from a gas inlet 23). It is also to be understood that the passages 33A may curve, as shown in FIG. 9, in a leading direction. The direction as well as the degree to which the passages are angled relative to the axial plane of the rotor are dependent, inter alia, on the design of the second stage of the rotor which in turn is dependent on the particular application of the turbine (i.e., the characteristics of the rotatable load driven by the turbine) and the characteristics of the gas under pressure driving the turbine.

Figure 5:
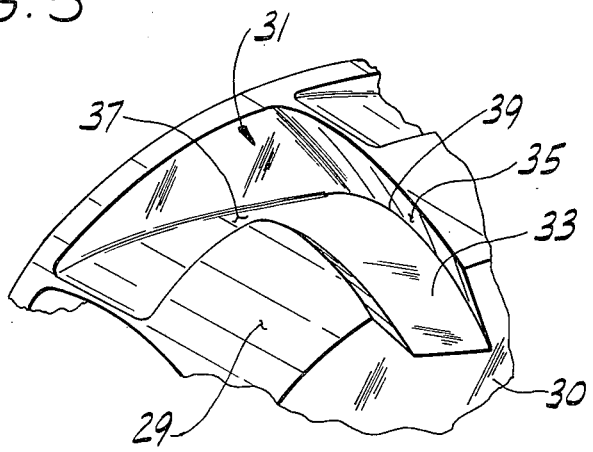
FIG. 5 is an enlarged perspective of one of a plurality of recesses in the first stage as seen from a point inside the first stage.

Each recess 31 also has a leading surface 35 and a trailing surface 37 (see FIG. 5). Each of these surfaces extends in a leading direction into the first stage 11 from its peripheral surface 29. These surfaces converge in a leading direction to a line of intersection 39 (see FIGS. 2, 4 and 5). The recesses 31 communicate with each gas inlet 23 and receive a charge of gas under pressure in a stream as the rotor 10 rotates. The gas inlet 23 is angled so as to direct the gas in a leading direction toward the line of intersection 39, thereby propelling the rotor. As shown in FIG. 2, each recess 31 is in communication with one of the inlets 23 and receives gas under pressure from the inlet for approximately a 90° arc of rotation of the rotor 10, the wall 9 closing the passage 33 of the recess for at least a substantial portion of this arc of rotation to hold gas in the recess for compression. The passage 33 is open for the arcs of rotation of the rotor during which the recess is not in communication with the inlets 23, and thus is open for a major portion of the arc of rotation of the rotor during which the respective recess does not receive gas from the inlets for enabling exit of compressed gas from the recess.

Figure 8:
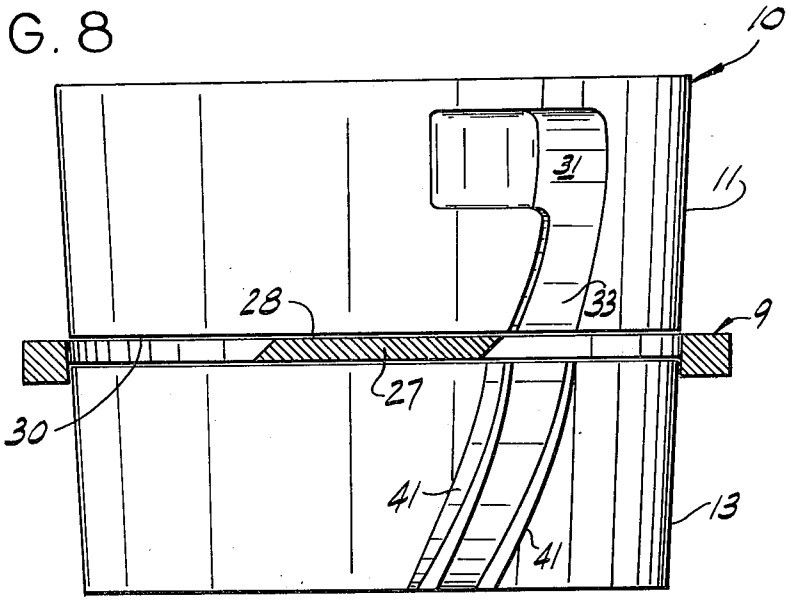
FIG. 8 is a fragmentary view similar to FIG. 7 but showing the recess in a further moved position.
Figure 9:
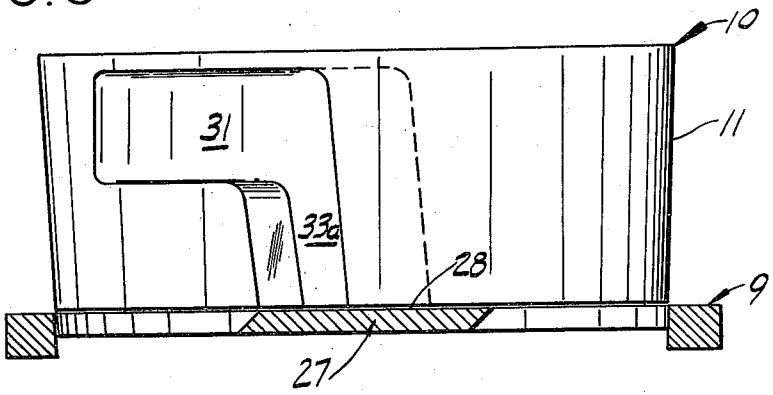
FIG. 9 is fragmentary view of FIG. 1 but showing a first stage having recesses of an alternative embodiment.
Figure 6:
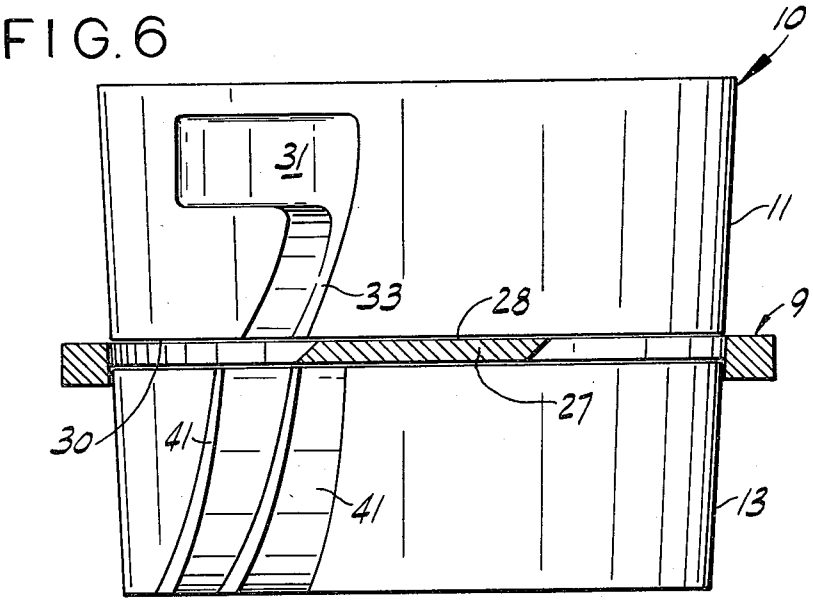
FIG. 6 is a fragmentary view of FIG. 1 showing the recess in a position adjacent the closing sector.
Figure 7:
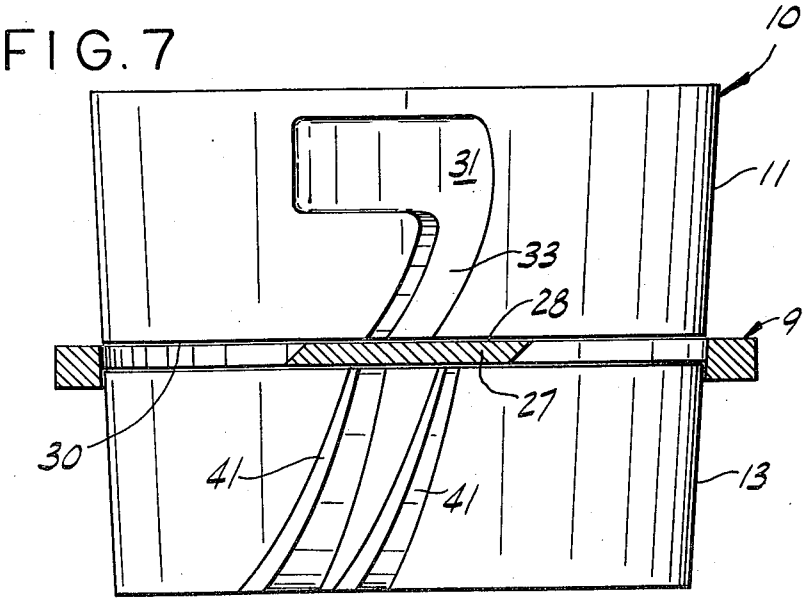
FIG. 7 is a fragmentary view similar to FIG. 6 showing the recess in a moved position in which the recess is closed by the closing sector.

In the operation of the turbine 1, as generally indicated in FIGS. 6–8, the first stage 11 of the rotor rotates to a position in which one of the recesses 31 approaches one of the closing sectors 27. The recess 31 then opens into communication with the gas inlet 23 and receives the stream of gas under pressure (see FIG. 6). During steady state operations of the turbine 1, the stream of gas flows into the recess at a linear velocity greater than (e.g., twice although a ratio greater and less than twice is also possible) the velocity of the peripheral surface 29 of the first stage 11. Before the stream of gas can flow out of the then opened passage 33, however, the first stage rotates to a position in which the passage 33 is closed by the imperforate surface 28 of the closing sector 27 of the partition 9 (see FIG. 7). The recess 31 remains in communication with the gas inlet 23 and continues to receive the stream of gas for the arc of rotation of the first stage 11 during which the passage 33 is closed by the closing sector 27. The stream of gas received in the recess 31 propels the rotor as the stream of gas impacts against the leading and trailing surfaces (35 and 37, respectively). At the same time, the pressure of the gas already received and, thus, held in the recess 31 is increased as additional gas enters the recess 31. The convergent configuration of the leading and trailing surfaces enhances the compression of the gas. The gas in the recess 31, once compressed, applies a force on the leading and trailing surfaces (35 and 37, respectively) tending to rotate the rotor 10 away from the gas inlets 23.

The pressure of the gas in the recess continues to increase as additional gas is received in the recess and it reaches a maximum immediately before the first stage 11 rotates over the closing sector 27 to a position where the passage 33 is at the open or ported portion of the partition 9 (see FIG. 8). At the ported portion of the partition, the compressed gas rapidly expands and exits the passage 33 and flows toward the second stage in a vortex flow path along the longitudinal axis of the turbine. If the passage 33 curves in a trailing direction, the expansion of the gas creates a reaction force applied to the surface of the recess 31 thereby impulsing the first stage 11 away from the gas inlet 23. To avoid potentially destructive pulsing of a turbine having two or more gas inlets 23, caused by simultaneous impulsing of two or more recesses 31 in the first stage 11, the number of recesses should be an odd number which is other than a multiple of the number of gas inlets 23.

While the first stage of the rotor converts a substantial portion of the kinetic and potential (i.e., pressure) energy of the gas under pressure into rotary shaft work, the gas likely still has some useful energy (i.e., energy that can be converted to net rotary shaft work) as it flows axially from the first stage 11 toward the open end 21 of the chamber. The second stage 13 of the rotor is incorporated into the turbine 1 to convert this remaining useful energy. It has a plurality of peripheral vanes 41, the number of which is the same as or a multiple of the number of recesses 31, each having a surface for propulsion of the second stage 13 by the gas. The vanes 41 which may be intergrally cast with the second stage of the rotor or, alternatively, may comprise separate elements secured to the second stage by conventional fastening means (not shown) are so located relative to the recesses 31 as to have each passage 33 aligned with a space between adjacent vanes, so that gas exiting from a recess 31 will impinge against one of the adjacent vanes 41 to propel the second stage. If the gas exiting the second stage has any remaining useful energy, additional stages similar to the second stage 13 may be incorporated into the rotor 10 to convert the remaining energy of the gas. A bladed stator for each of these added stages would be incorporated into the housing 3 upstream of each added stage.

Figure 10:
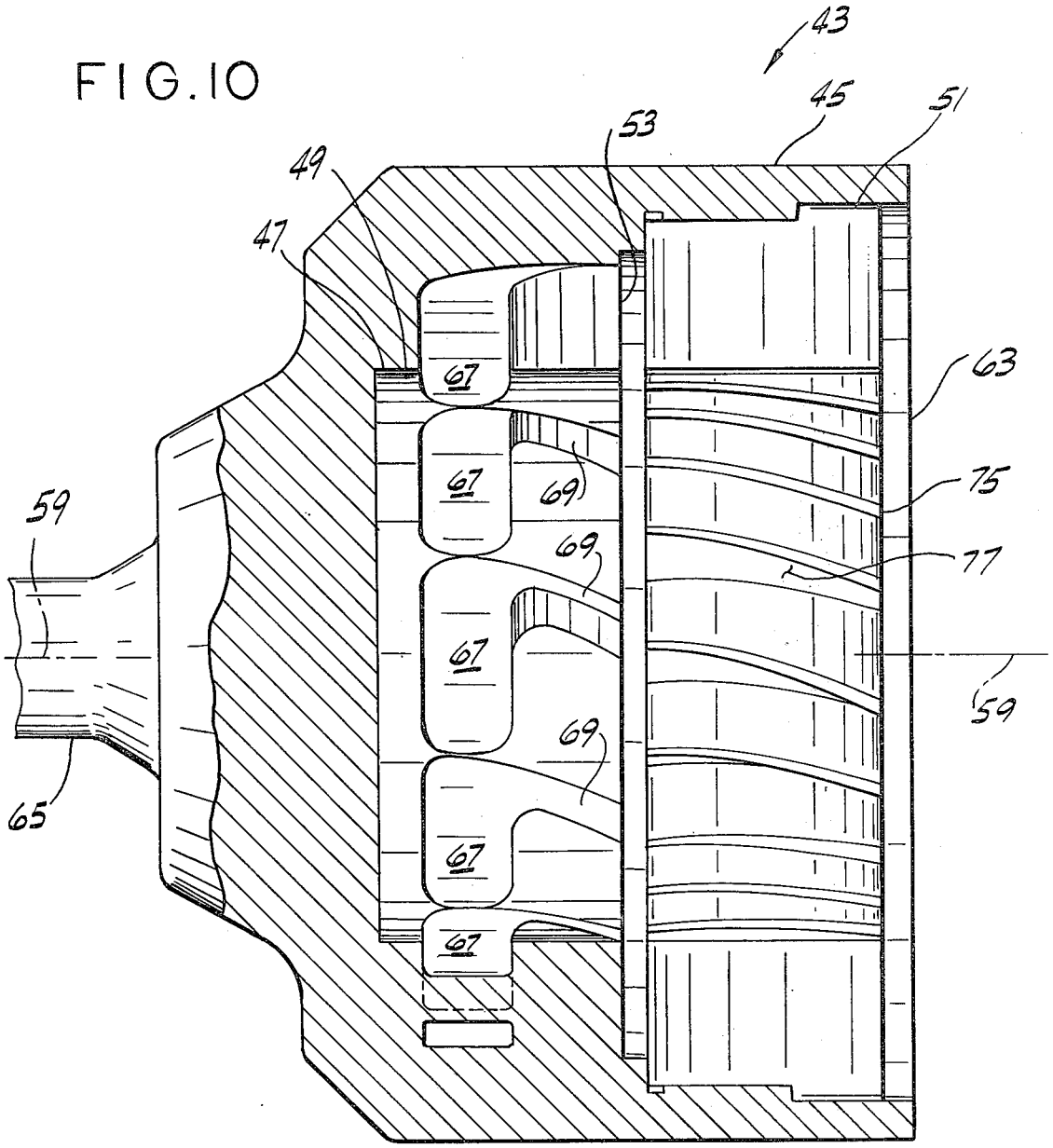
FIG. 10 is a section of a rotor of a second rotary gas turbine of this invention.
Figure 11:
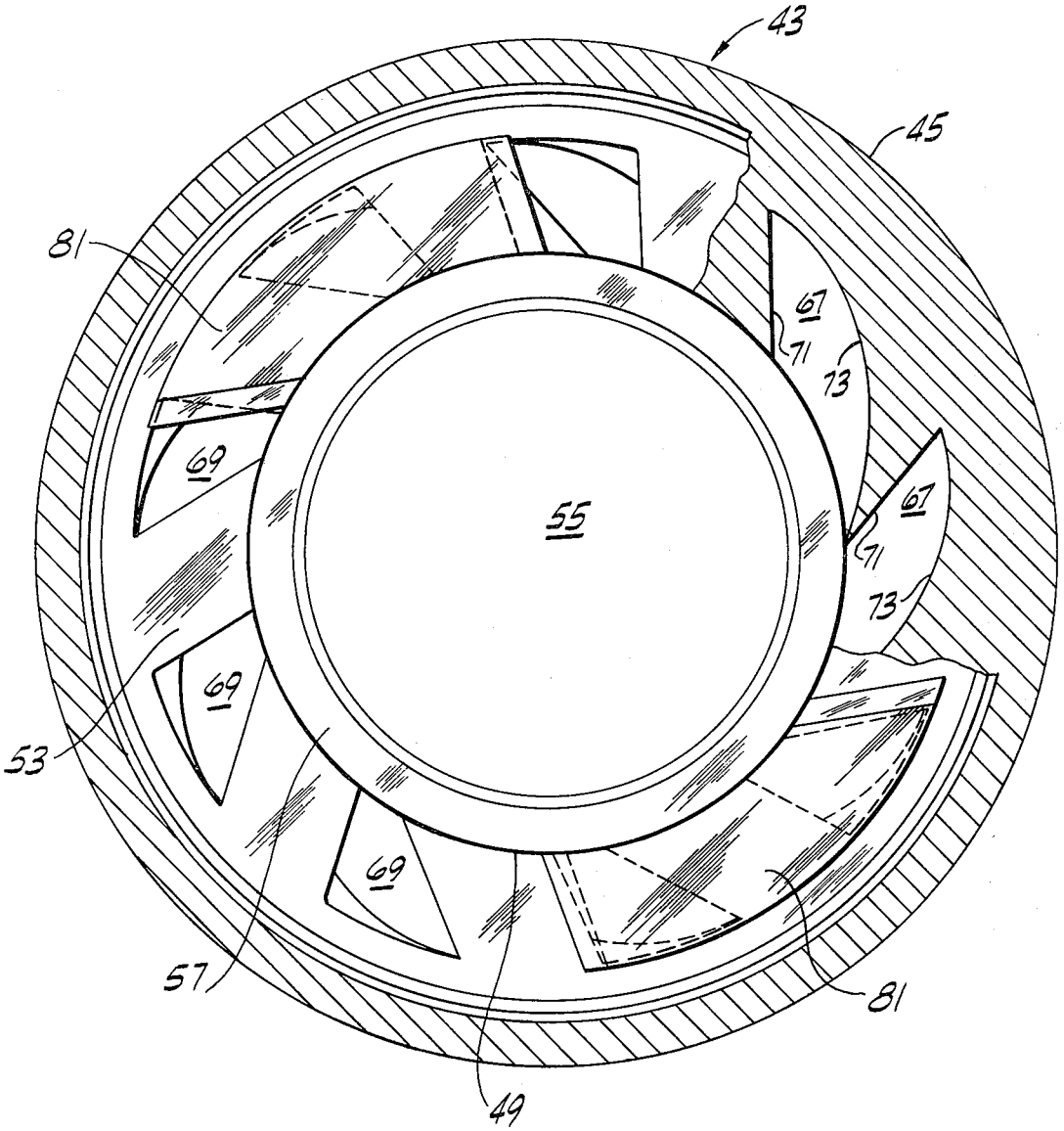
FIG. 11 is an end view of the turbine showing the rotor and a stator in the rotor with parts removed and other parts broken away.

A second rotary or concave gas turbine 43 of this invention is shown in FIGS. 10–11. The second rotary gas turbine is generally similar to the first turbine 1, differing principally in that it has a rotor 45 extending around and mounted for rotation about a stator, rather than rotor 10 which is mounted for rotation within a housing 3 as in the first turbine 1. The rotor 45 has an interior surface 47 defining a first chamber 49 constituting the first stage of the rotor, a second chamber 51 constituting the second stage of the rotor, and an annular shoulder 53 between the chambers. This turbine 43 further comprises a stator 55 in the first and second chambers having a wall 57 (see FIGS. 12–14). The rotor is mounted for rotation about the stator on an axis 59 therethrough.

In particular, the portions of the interior surface 47 of the rotor 45 defining the first and second chambers (49 and 51, respectively) are surfaces of revolution about the axis 59 (see FIG. 10); the second chamber 51 being of a larger diameter than that of the first chamber 49. The rotor 45, at its shoulder 53, is in rotary sealing relationship with the wall 57 of the stator 55 and, at that portion of its interior surface 47 defining the first chamber 49, is in rotary sealing relationship with the periphery 61 of the stator 55 which may comprise a combustor as discussed more fully hereinafter. The second chamber 51 of the rotor is open at its ends 63 opposite the shoulder 53. A rotary output shaft 65 extends along axis 59 from the end of the rotor 45 opposite its open end 63. The shaft 65 is rotatably mounted in bearings (not shown) and is adapted to be coupled to a rotatable load (not shown).

The rotor 45 has a plurality of recesses 67 spaced at equal intervals around the periphery of the first chamber 49. Each recess 67 extends radially outwardly into the rotor from its interior surface 47 and has a passage 69 extending to its shoulder 53. The passages may be bores (not shown) spaced radially outwardly from the interior surface 47 of the rotor. Alternatively, the passages may extend to the interior surface 47 (see FIGS. 10 and 11), in which case the periphery 61 of the stator 55 closes the side of the passages 69 extending to the interior surface 47. As in the first turbine 1, passage 69 of the second turbine 43 may curve with respect to an axial plane of the rotor in either a leading direction (not shown) or a trailing direction (see FIG. 10). In addition, as in the first turbine, each recess of the second turbine is defined in part by a leading surface 71 and a trailing surface 73 (see FIG. 11). These surfaces extend into the rotor 45 and converge in a leading direction.

Around the periphery of the portion of the interior surface 47 defining the second chamber 51, the rotor 45 has a plurality of vanes 75 extending radially inwardly toward the axis 59 for converting the useful energy of the gas exiting the first stage. The vanes are preferably intergrally formed with the rotor 43 such as by casting, but may also be separate elements secured to the interior surface 47 by conventional fastening means (now shown). Each vane 75 has a surface 77 for propulsion of the rotor by gas exiting the recesses 67 and flowing toward the open end 63 of the second chamber 51. As in the first turbine 1, the vanes 75 of the second turbine 43 are so located relative to the recesses 67 as to have each passage 69 at the shoulder 53 aligned with a space between adjacent vanes 75, so that gas exiting from the recesses will impinge against the propulsion surface 77 of one of the adjacent vanes 75. If the gas exiting this stage of vanes has useful energy, additional stages of rotating vanes may be integrally cast into the rotor 45 or secured by conventional fastening means to the rotor to convert the remaining useful energy. A stage of stationary blades or vanes for each of these added stages of the rotors would be incorporated on the periphery of the stator 55 upstream of each added stage of vanes.

Figure 12:
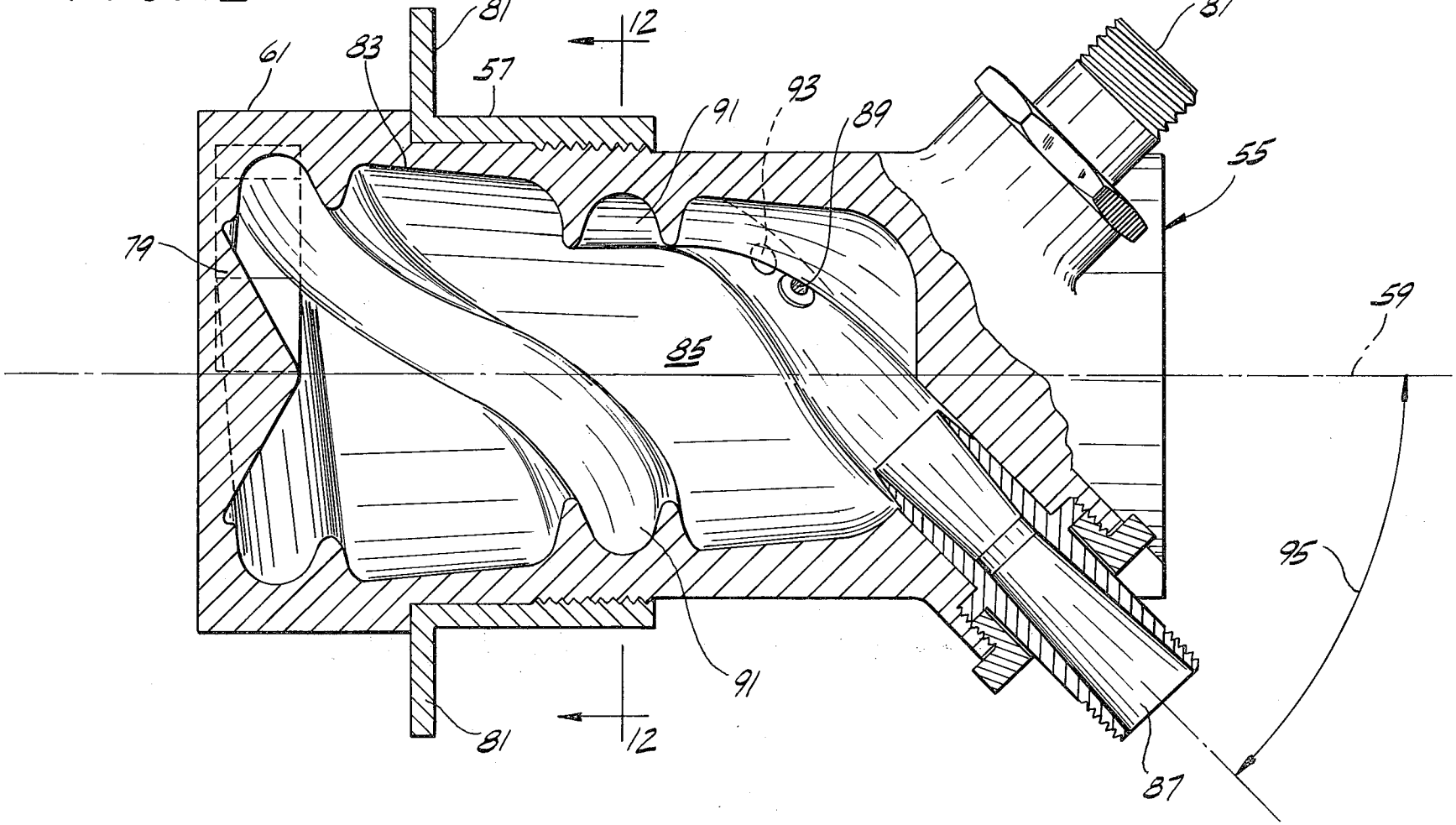
FIG. 12 is an elevation of the stator with parts in section showing a combustion chamber in the stator.

The stator 55 has two ports 79 for gas under pressure, such as steam, the products of combustion or the like, for directing the gas under pressure into the recesses 67 in a leading direction to propel the rotor 45 (see FIG. 12). The wall 57 on the rotor comprises closing sectors 81 having an imperforate axial surface in sealing relationship with the shoulder 53 of the rotor 45 and an open or ported portion between the closing sectors 81 (see FIGS. 11, 13 and 14). Each closing sector 81 is adapted to block each of the passages 69 at the shoulder 53 of the rotor throughout a part of a revolution of the rotor (i.e., approximately a 60° arc of rotation as shown in FIG. 11) to hold gas in the recesses 67 for compression. The open or ported portions of the wall 57 allow for the exit of gas from each recess 67 via its respective passage 69 as the rotor rotates through another part of its revolution for expansion of the gas and resultant impulsing of the rotor 45.

If the products of combustion are used to propel the second turbine 43, the stator 55 may constitute the combustor for producing these products of combustion. The combustor which may be of a two-part construction with the parts releasably secured together by conventional fastening means (not shown), comprises a body having an interior surface 83 defining a combustion chamber 85, gas inlet ports 87 at one end of the body for directing gas, such as air, containing oxygen in a stream into the combustion chamber, fuel inlet ports 89 for directing fuel into the combustion chamber, and the ports 79 acting as outlet ports in directing gas under pressure into the recesses 67 in the rotor 45. The ports 87 direct the stream of gas into the combustion chamber 85 in a flow path having an axial component and a tangential component (i.e., in a vortex) relative to the combustion chamber (see FIGS. 12 and 13). The interior surface 83 of the combustor has two grooves 91 (see FIG. 12) each extending helically from one of the gas inlet ports 87 to one of the outlet ports 79 for causing the stream of gas to flow through the combustor in a vortex flow path (i.e., with an axial component and a circular component). The fuel which may be any volatile liquid hydrocarbon enters the combustion chamber in a stream via the fuel inlet ports 89 at points adjacent the gas inlet ports 87 and in a direction substantially perpendicular to the flow direction of the stream of gas. The stream of gas, as its swirls in a vortex, disperses the stream of fuel into a multitude of small drops that are quickly vaporized in the gas. The resulting gas-fuel mixture has a gas to fuel ratio in the range of 16 to 1 to 70 to 1; the higher ratios being preferred as they result in lower combustion temperatures. The gas-fuel mixture flows from the fuel inlet port 89 past a means for igniting the mixture, such as a spark plug 93. The grooves 91 direct the products of combustion from the spark plugs 93 toward the outlet ports 79 along helical flow paths. The outlet ports 79 direct the products of combustion toward the recesses 67 in the rotor 45 along flow paths generally tangential to the combustion chamber 85.

Figure 13:
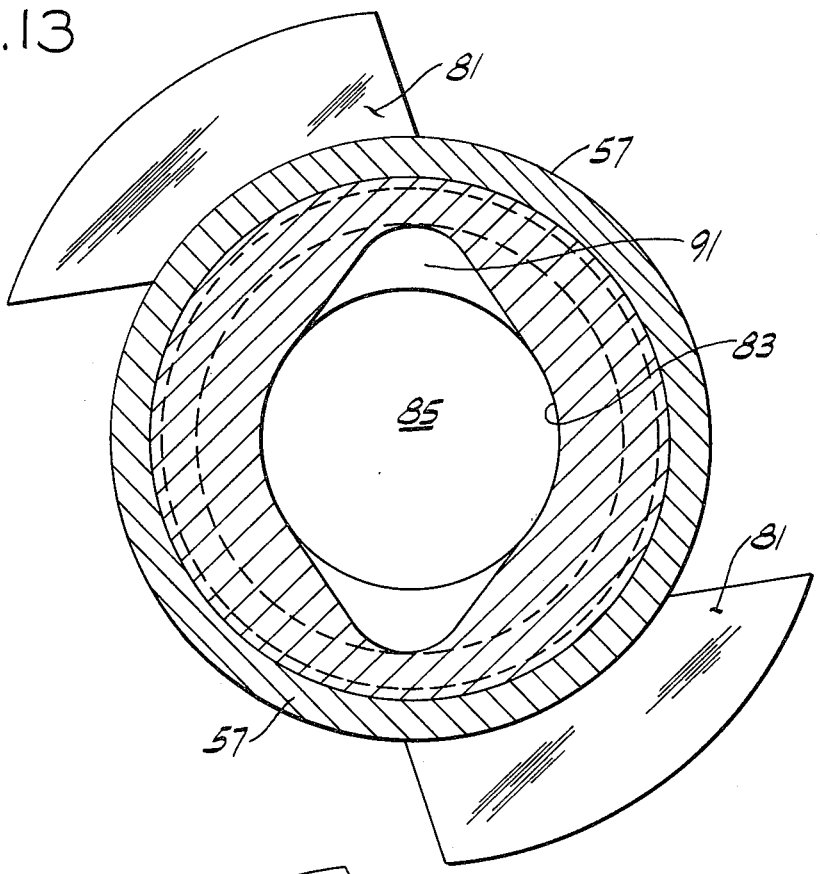
FIG. 13 is a section along lines 13—13 of FIG. 12.
Figure 14:
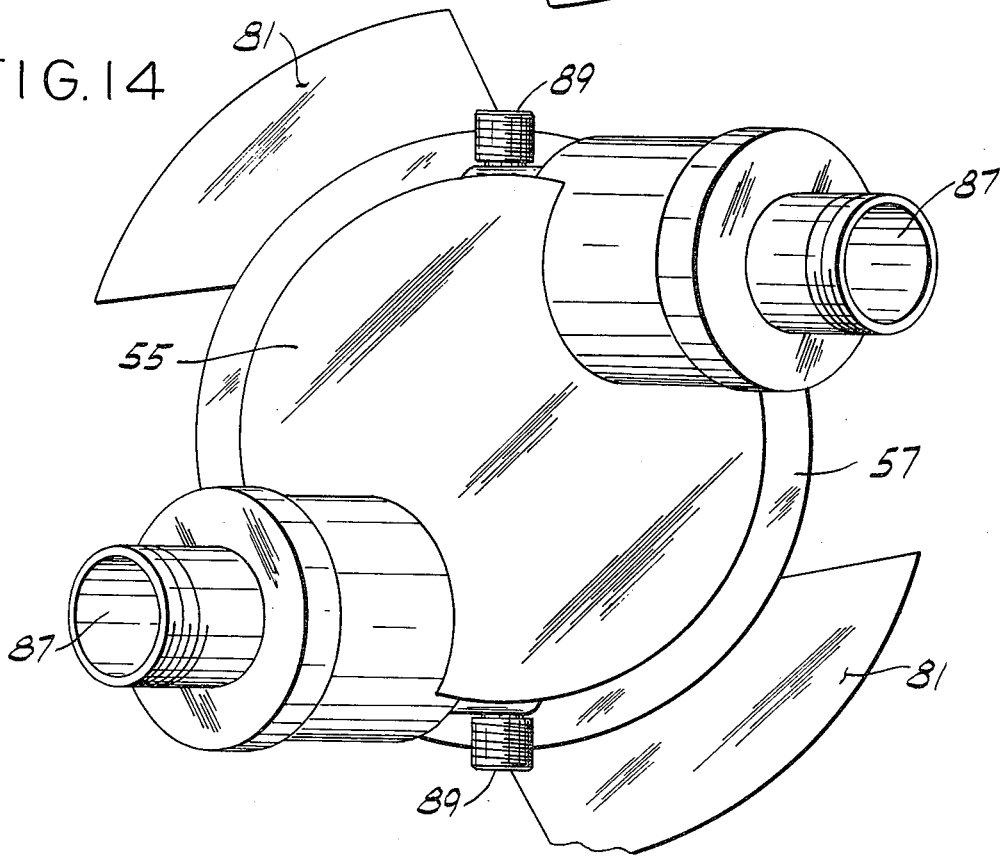
FIG. 14 is an end view of the stator.

While the combustor is shown in FIG. 13 as having two gas inlet ports 87, each positioned at an angle 95 of approximately 45° to the axis of the combustor, the number of gas inlet ports and their angled position can vary depending, inter alia, on the intended size and output capacity of the combustor and the type of fuel to be burned. The number of gas inlet ports 87 determines the number of helically extending grooves 91 and gas outlet ports 79 in that there is one groove 91 and one outlet port 79 for each gas inlet port 87. In addition, the number of gas inlet ports 87 determines the number of closing sections 81, in that there is one closing sector for each outlet port 79. As in the first turbine 1, if the second turbine 43 has two or more ports 79 for directing gas toward the recesses 67, the number of recesses should be an odd number which is other than a multiple of the number of ports 79, in order to avoid destructive pulsing of the rotor. FIG. 13 shows each of the grooves 91 as extending for one complete revolution around the interior surface 83 of the combustion chamber 85, but the number of revolutions each groove makes can vary depending, inter alia, upon the number of gas inlet ports 87 and the type of fuel to be burned.

In operation, the second turbine 43 of this invention converts the useful energy of the gas under pressure entering the recesses and flowing out the open end 63 of the second chamber 53 into rotary shaft work in a manner similar to that of the first turbine 1 of this invention. As the rotor 45 rotates to a position where one of the recesses 67 approaches one of the closing sectors 81, the recess opens into communication with the outlet port 79 and receives the stream of gas under pressure. The recess 67 remains in communication with the outlet port 79 for the arc of rotation of the rotor during which the passage 69 of the recess 67 is closed by the closing sector 81. The stream of gas received in the recess 67 propels the rotor 45 as the gas impacts against the leading and traling surfaces (71 and 73, respectively) of the recess. At the same time, the gas that has been received and is, thus, held in the recess 67 is compressed as additional gas enters the recess. As in the first turbine 1, the convergent configuration of the leading and trailing surfaces of the second turbine 43 enhances this compression. As the gas in the recess is compressed to its maximum pressure the rotor 45 rotates to a position where the passage 69 is at the open or ported portion of the wall 57. The compressed gas then rapidly expands and impulses the rotor as it exists the passage 69 at the shoulder 53 and flows toward the vanes 75 in the second chamber 51. The gas exiting the passage 69 impinges against the propulsion surface 77 of one of the vanes 75 to drive the rotor 45. The gas then flows between the vanes 75 and exits the turbine at the open end 63 of the second chamber 51.

Each of the structural components of the first and second turbines of this invention (i.e., the housing 3, the rotor 10, and the partition 9 of the first turbine 1, and, the rotor 45 and stator 55 of the second turbine 43) may be constructed of the same high strength and high-temperature resistant alloys used in conventional rotary gas turbines. However, in contrast to the prior art turbines, precision machining of the structural elements of the turbines of this invention is required only on those surfaces which are in sealing relationship and to effect proper balancing of the rotors. Due to the increased efficiency of the turbines of this invention, these turbines can be made smaller than prior art turbines and, thus, can operate at higher rotating speeds than are possible in the prior art turbines. Higher speed operation is desirable for driving loads that are more efficient at high operating speeds, such as electrical generators, and where high power-to-weight ratios are required, in that the power developed by a rotary turbine is a function of its speed of rotation.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A rotary gas turbine comprising:

a housing having a chamber therein for a rotor;

the chamber having a periphery which is a surface of revolution about an axis extending through the chamber;

a rotor mounted for rotation in the chamber on said axis; and a stator wall at one end of the chamber;

said rotor having an end face in rotary sealing relationship with said wall and a peripheral surface in rotary sealing relationship with the periphery of said chamber, said rotor further having a plurality of recesses spaced at equal intervals around its periphery, each recess extending radially into said rotor from said peripheral surface thereof and having a passage extending to said end face thereof;

said housing having an inlet for gas under pressure for directing the gas into said recesses in the rotor at an angle for propulsion of the rotor;

said wall being adapted to block each of said passages at said end face of the rotor throughout a part of a revolution of the rotor to hold gas in the recesses for compression and said wall being ported for exit of gas from each recess via the respective passage as the rotor rotates through another part of its revolution for expansion of the gas and resultant impulsing of the rotor, the passage of each recess being closed by the wall for at least a substantial portion of the arc of rotation of the rotor during which the recess receives gas from the inlet and being open during a major portion of the arc of rotation of the rotor during which the recess does not receive gas from the inlet.

2. A rotary gas turbine comprising:

a housing having a chamber therein for a rotor;

the chamber having a periphery which is a surface of revolution about an axis extending through the chamber;

a rotor mounted for rotation in the chamber on said axis; and a stator wall at one end of the chamber;

said rotor having an end face in rotary sealing relationship with said wall and a peripheral surface in rotary sealing relationship with the periphery of said chamber, said rotor further having a plurality of recesses spaced at equal intervals around its periphery; each recess extending radially into said rotor from said peripheral surface thereof and having a passage extending to said end face thereof;

said housing having an inlet for gas under pressure for directing the gas into each recess in the rotor at an angle for propulsion of the rotor;

said wall being adapted to block each of said passages at said end face of the rotor throughout a part of a revolution of the rotor to hold gas in the recesses for compression, and said wall being ported for exit of gas from each recess via the respective passage as the rotor rotates through another part of its revolution for expansion of the gas and resultant impulsing of the rotor;

each of said recesses having a leading surface and a trailing surface, each surface extending in a leading direction into the rotor from its peripheral surface, said surfaces converging in a leading direction, the convergent configuration of the surfaces enhancing the compression of gas within the recess.

3. A turbine as set forth in claim 1 or 2 wherein said housing has at least two said inlets for gas under pressure.

4. A turbine as set forth in claim 3 wherein the number of said recesses in the rotor is an odd number which is other than a multiple of the number of said inlets.

5. A turbine as set forth in claim 1 or 2 wherein said chamber constitutes a first stage rotor chamber and said housing further comprises a second stage rotor chamber having a periphery which is a surface of revolution about said axis which also extends through said second stage rotor chamber, said wall constituting a partition between said chambers, said second stage rotor chamber being open at its end opposite the partition.

6. A turbine as set forth in claim 5 wherein said rotor comprises a first stage mounted for rotation in said first stage rotor chamber on this axis thereof and a second stage mounted for rotation in said second chamber on the axis thereof.

7. A turbine as set forth in claim 6 wherein said second stage has peripheral vanes, each vane having a surface for propulsion of the second stage by gas exiting the first stage and flowing toward the open end of the second chamber.

8. A turbine as set forth in claim 7 further comprising a rotary output shaft extending along the axis of the first chamber, said first and second stages being secured to said shaft.

9. A turbine as set forth in claim 8 wherein said vanes are so located relative to said recesses as to have each passage at said end face of the first stage rotor aligned with the space between adjacent vanes so that gas exiting from said recesses will impinge against the propulsion surface of one of said adjacent vanes.

10. A turbine as set forth in claim 6 wherein said partition comprises a closing sector having an imperforate surface in sealing relationship with said end face of the first stage of the rotor.

11. A turbine as set forth in claim 10 wherein said housing has a plurality of said inlets for gas under pressure and the partition has a plurality of said closing sectors, the number of said sectors being equal to the number of said inlets.

12. A turbine as set forth in claim 1 or 2 wherein each of said passages in the rotor extends radially outwardly to said peripheral surface of the rotor.

* * * * *